US005576595A

United States Patent [19]

Inoue

[11] Patent Number: 5,576,595

[45] Date of Patent: Nov. 19, 1996

[54] SHADOW MASK COLOR PICTURE TUBE

[75] Inventor: Hiroyoshi Inoue, Nagaokakyo, Japan

[73] Assignee: Mitsubishi Denki Kabushiki Kaisha, Tokyo, Japan

[21] Appl. No.: 391,514

[22] Filed: Feb. 21, 1995

[30] Foreign Application Priority Data

Feb. 21, 1994 [JP] Japan ..... 6-022456

[51] Int. Cl.[6] ..... H01J 29/80

[52] U.S. Cl. ..... 313/402; 313/406; 313/407; 313/408

[58] Field of Search ..... 313/402, 406, 313/407, 408

[56] References Cited

U.S. PATENT DOCUMENTS 4,963,786 10/1990 Tokita et al. ..... 313/407 X
5,210,459 5/1993 Lee ..... 313/406 X

FOREIGN PATENT DOCUMENTS 62-216137 9/1987 Japan .

OTHER PUBLICATIONS

Eisho Nosaka et al "Running Changes In Color Picture Tubes Convergence and Landing" Jun. 1969.

K. Tokita et al "A New Shadow–Mask Suspension System For A Color CRT: Corner–Suspended Mask" vol. 29/1, 1988, pp. 13–17.

K. Tokita et al "Geometric Compensation For Mask Expansion Of Colour Cathode–Ray Tubes" Display, Apr. 1991–pp. 74–79.

*Primary Examiner*—Sandra L. O'Shea
*Assistant Examiner*—Mack Haynes

[57] ABSTRACT

A shadow mask color picture tube comprising a frame having two first parts each extending in a same direction and two second parts each extending in a direction perpendicular to the first parts and holding the shadow mask. A stud pin is provided at each of four corners of the skirt, and a first supporting member is provided on each of four corners of the frame. The first supporting members are connected to the stud pins so as to support the frame elastically on the skirt. Non-extensible, flexible thin metal members are provided so as to pull both the first parts of the frame in the same direction with respectively equal forces to the skirt of the panel. The forces act in the direction substantially parallel to that in which the first parts of the frame extend.

21 Claims, 7 Drawing Sheets

SHADOW MASK COLOR PICTURE TUBE

BACKGROUND OF THE INVENTION

This invention relates to a color picture tube provided with a shadow mask, and more specifically, to a structure wherein a frame holding a shadow mask is attached to the panel of a color picture tube.

A conventional shadow mask color picture tube is disclosed in, for example, Japanese Patent Kokai Publication 216137/1987 (S62-216137). This color picture tube comprises stud pins at four corners of a skirt, a frame that holds a shadow mask, and elastic supporters that support the frame elastically on the stud pins of the skirt. This picture tube further comprises other stud pins on the upper and lower inner walls of the skirt, and other elastic supporters that elastically support the upper and lower long sides of the frame on these other stud pins. Hence, not only are the four corners of the frame supported by elastic supporters, but the two long sides of the frame are also supported by elastic supporters. This prevents twisting and deformation of the shadow mask due to its own weight.

However in the aforesaid conventional picture tube, as the frame is supported only by elastic supporters, the frame and shadow mask move in the direction of gravity depending on how the picture tube is positioned or oriented. Hence, if the picture tube is placed on its side (i.e. such that the long side of the panel is vertical), the shadow mask moves down in the direction of gravity (i.e. in the direction parallel to the long side of the panel). As a result, the positions of the holes in the shadow mask are displaced, the electron beams emitted by the electron gun pass through the holes in the mask do not land correctly on the phosphors or the panel, and color distortions of the displayed image occur.

This problem was even more serious when the phosphors consisted of thin stripes oriented in the direction parallel to the short side of the panel, and when the picture tube was large so that the frame and shadow mask were heavier.

SUMMARY OF THE INVENTION

It is therefore an object of this invention to provide a shadow mask color picture tube wherein color distortions do not easily occur regardless of the orientation of the picture tube.

According to one preferred mode, a shadow mask color picture tube comprises a frame having two first parts each extending in a same direction and two second parts each extending in a perpendicular direction to the first parts and holding the shadow mask. Stud pins are provided at the corners of the skirt, and first supporting members are provided on the corners of the frame. The first supporting members are connected to the stud pins so as to support the frame elastically on the skirt. Non-extensible, flexible thin metal members pull both of the first parts of the frame with respectively equal forces to the skirt of the panel. The forces act in the direction substantially parallel to that in which the first parts of the frame extend. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the shadow mask color picture tube according to this invention will now be described.

FIRST EMBODIMENT

Figure 1:
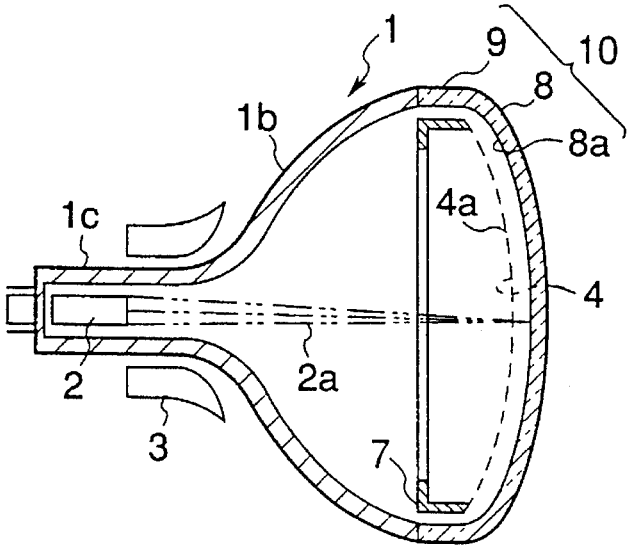
FIG. 1 is a schematic view in vertical section of the structure of a first embodiment of a shadow mask color picture tube according to this invention.
Figure 3:
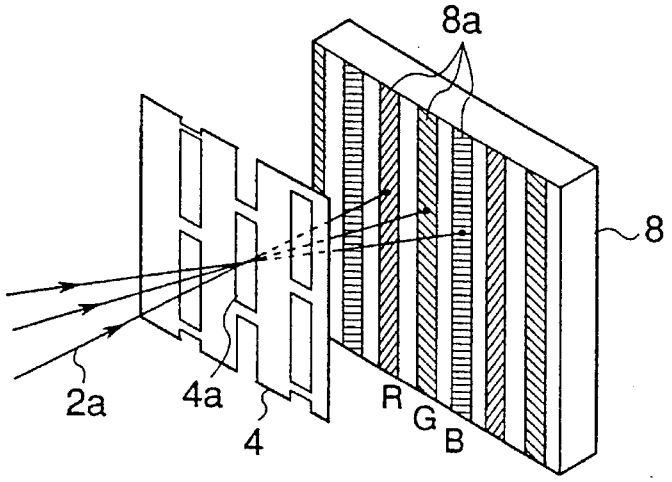
FIG. 3 is an inclined view showing partial enlargements of the panel and shadow mask of FIG. 1.

Referring to FIG. 1 or FIG. 3, a color picture tube according to the first embodiment has a neck 1*c* provided with an electron gun 2, a funnel 1*b* joined to the neck 1*c*, and panel 10 comprising a rectangular image display screen 8 (only part of the screen 8 is shown in FIG. 3) whereon a plurality of phosphors 8*a* are disposed to produce the colors red (R), green (G) and blue (B) and a skirt 9 that extends from the edges of the screen 8 to the funnel 1*b*.

As shown in FIG. 1 and FIG. 3, the color picture tube 1 comprises a shadow mask 4 arranged facing the screen 8 and a frame 7 holding the shadow mask 4. This shadow mask 4 has a plurality of throughholes through which an electron beam 2*a* from the electron gun 2 passes. The frame 7 has two long sides 7*a*, 7*c* and two short sides 7*b*, 7*d*, and as normally installed, the long sides 7*a*, 7*c* are arranged horizontally (in the direction perpendicular to the plane of the paper in FIG.

Figure 2:
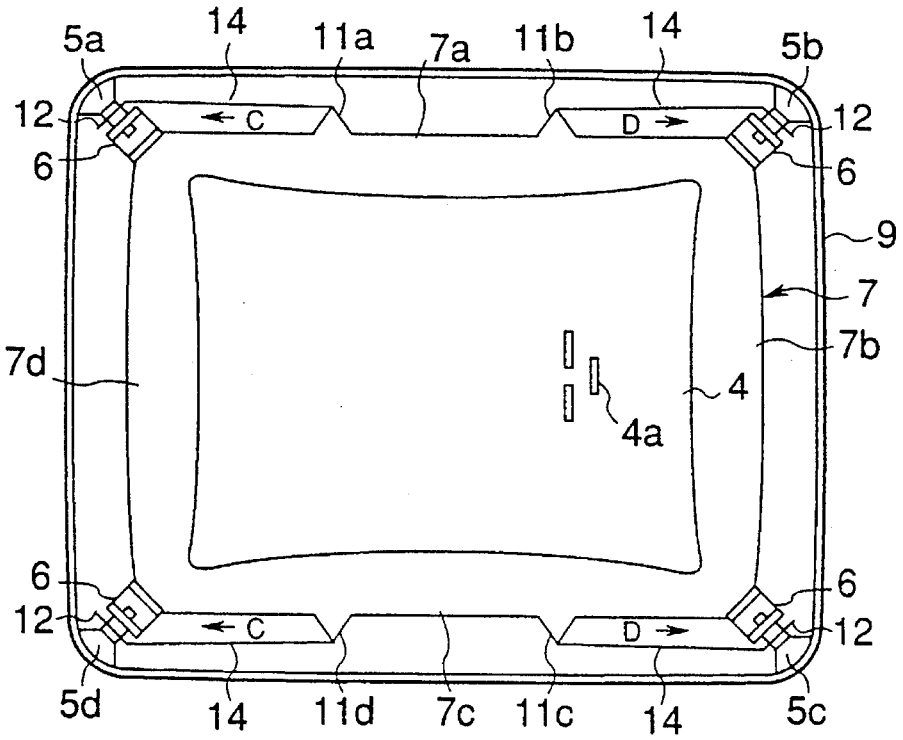
FIG. 2 is shows the panel, frame and shadow mask of FIG. 1 viewed from the electron gun.

1, in the transverse direction in FIG. 2, and in the direction at right angles to the phosphor stripes 8*a* in FIG. 3), while the short sides 7*b*, 7*d* are arranged vertically (in the vertical direction in FIG. 1 and FIG. 2).

Figure 4:
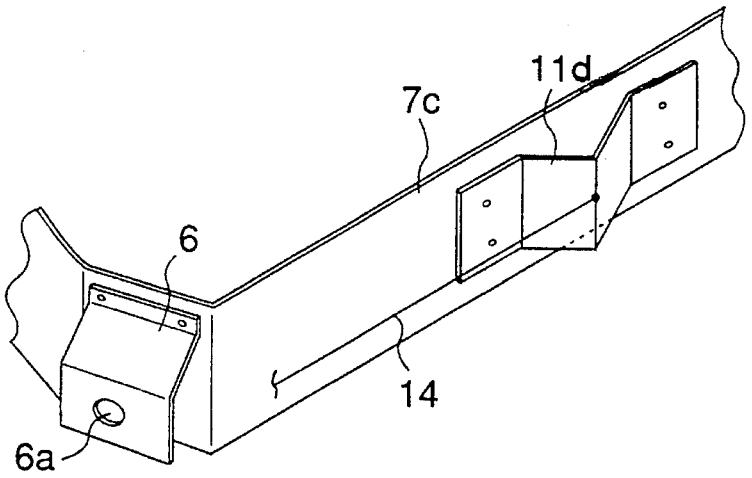
FIG. 4 is an inclined view showing enlargements of the frame, a flat spring and a metal member of FIG. 2.
Figure 5:
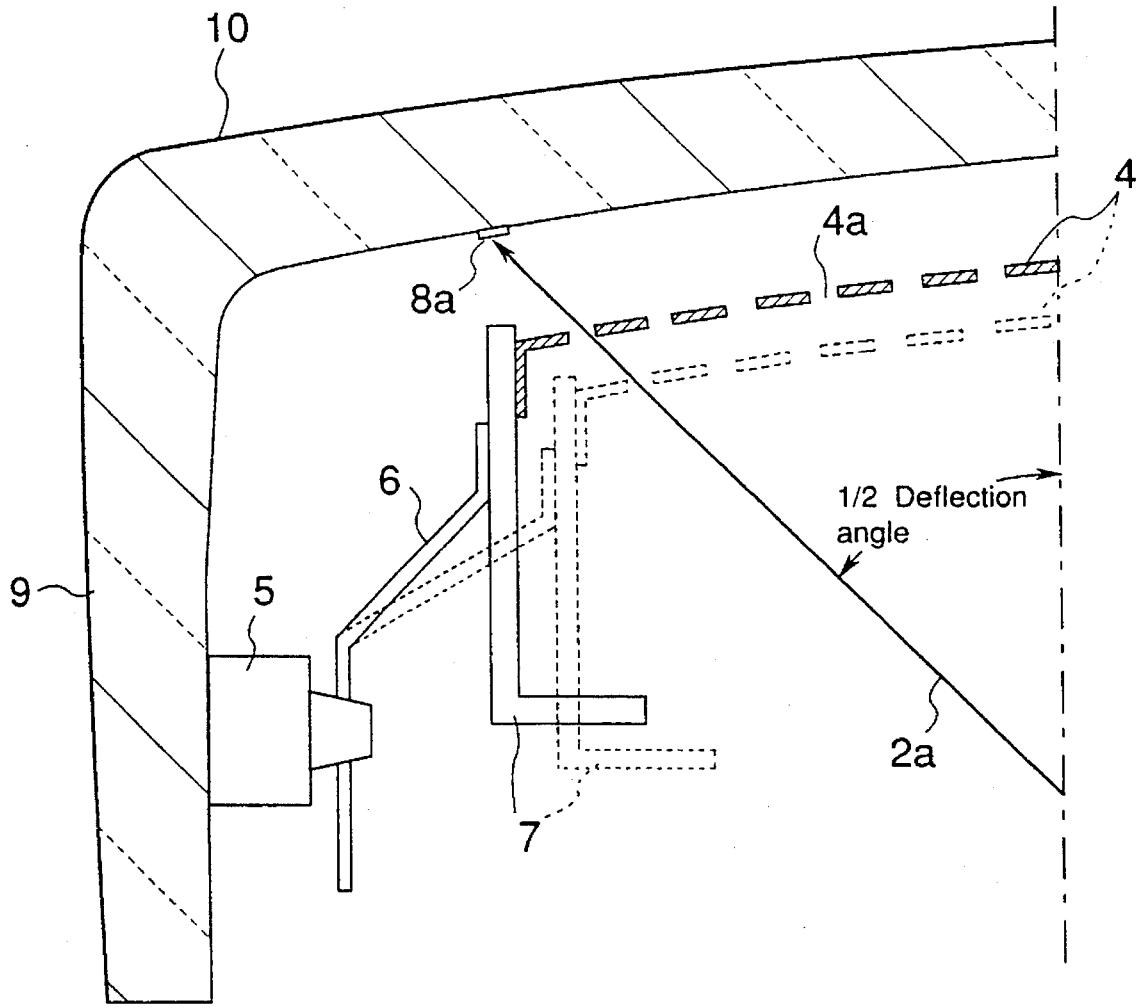
FIG. 5 is a plan view including a partial section schematically showing the structure of a first embodiment of the shadow mask color picture tube according to this invention.

As shown in FIG. 2, the color picture tube 1 further comprises stud pins 5*a*, 5*b*, 5*c*, 5*d* respectively situated at the four corners of the skirt 9, and flat springs 6 that function as elastic supporters respectively attached to the four corners of the frame 7. As shown in FIG. 4, each of the flat springs 6 has an engaging hole 6*a* that engages with the stud pin. The engaging holes 6*a* are attached to the stud pins 5*a*, 5*b*, 5*c*, 5*d* on the skirt 9, and the flat springs 6 therefore exert a force in a direction tending to separate the corners of the frame 7 from the corners of the skirt 9. The frame 7 is thereby elastically supported on the skirt 9. The flat spring 6 is shown in FIG. 5. The shadow mask 4 and frame 7 which are in positions shown by the dotted lines when the color picture tube is cold, move to positions shown by the solid lines when the color picture tube is hot due to the thermal expansion of the shadow mask 4 and the action of the flat spring 6.

Figure 6:
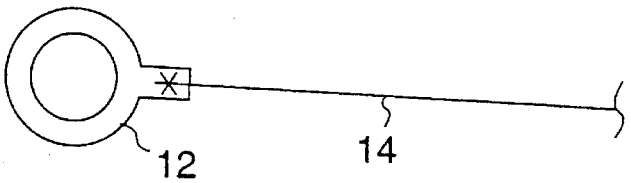
FIG. 6 is an enlargement of a metal member and washer of FIG. 2.

As shown in FIG. 2, FIG. 4 or FIG. 6, the color picture tube 1 still further comprises projections 11*a*, 11*b*, 11*c*, 11*d* attached by welding or the like to the long sides 7*a*, 7*c* of the frame 7, non-extensible, flexible thin metal members 14, for example piano wires, that pull each of the projections 11*a*, 11*b*, 11*c*, 11*d* with an equal force respectively towards the stud pins 5*a*, 5*b*, 5*c*, 5*d* in the direction C or D, and washers 12 that attach these metal members 14 to the stud pins 5*a*, 5*b*, 5*c*, 5*d*. As mentioned above, the shadow mask 4 and frame 7 move in a direction perpendicular to the screen 8 (the front-back direction of the tube), but as the metal members 14 are flexible, this does not interfere with the action of the shadow mask 4. The projections 11*a*, 11*b* on the upper long side 7*a* of the frame 7, and the projections 11*c*, 11*d* on the lower long side 7*c* of the frame 7, are preferably disposed in positions which are respectively vertically symmetrical. Further, the projections 11*a*, 11*b* and the projections 11*c*, 11*d* are preferably arranged to be symmetrical to the left and right. The washers 12 are preferably respectively welded, for example by laser welding, to the stud pins 5*a*, 5*b*, 5*c*, 5*d*: Since the frame 7 is installed on and removed from the panel 10 at several times while manufacturing, the metal members 14 are attached to the stud pins 5*a*, 5*b*, 5*c*, 5*d* when the frame 7 is finally installed. It is moreover desirable that the thermal expansion coefficient of the metal members 14 is the same as or less than that of the panel 10. This is due to the fact that the metal members 14 become hotter than the panel 10 when the color picture tube is operating.

In this color picture tube 1, when for example the color picture tube 1 is placed on its short side, the shadow mask 4 does not move in the direction of gravity as the metal members 14 pull the shadow mask 4 in the opposite direction, therefore the positions of the throughholes 4*a* in the shadow mask 4 are not shifted in the direction of gravity. Describing this in further detail with reference to FIG. 2, when the short side 7*d* of the frame 7 is uppermost and the long sides 7*a*, 7*c* are vertical, in the conventional tube, the shadow mask moved down in the direction of gravity (towards the short side 7*b*). In the color picture tube 1 according to this invention, however, the metal members 14 pull the frame 7 in the direction C opposite to the direction of the gravity, so the shadow mask 4 does not move down in the direction of gravity. Hence, even if the phosphors 8*a* are thin stripes oriented in the direction parallel to the short sides 7*b*, 7*d* of the frame 7, the electron beam 2*a* emitted by the electron gun 2 that has passed through the throughholes 4*a* in the shadow mask 4, lands correctly on the phosphors 8*a* of the panel 10.

In the aforesaid embodiment, the case was described where the metal members 14 are attached to the stud pins via the washers 12, however the metal members 14 may also be directly attached to the stud pins.

In the aforesaid embodiment, the case was described where four metal members 14 are installed, however either two metal members 14 pulling the long sides 7*a*, 7*c* in the direction C or two members 14 pulling the long sides 7*a*, 7*c* in the direction D may be removed.

SECOND EMBODIMENT

Figure 7:
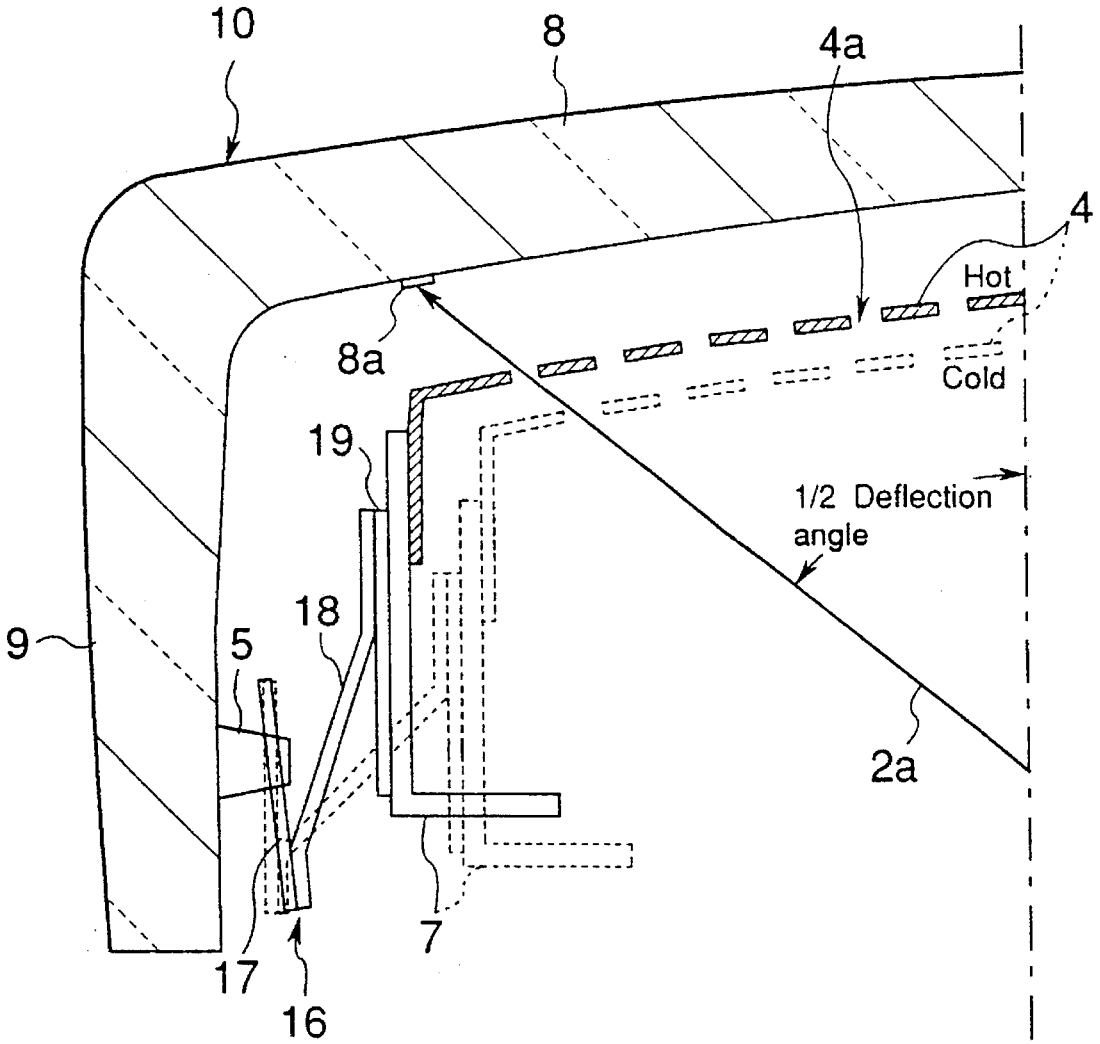
FIG. 7 is a plan view including a partial section schematically showing the structure off a second embodiment of the shadow mask color picture tube according to this invention.

FIG. 7 is a plan view including a partial section schematically showing the structure of a second embodiment of the color picture tube according to this invention. In the aforesaid first embodiment, the ease was described where the frame 7 is supported by the flat springs 6, but a supporting mechanism 16 which causes the shadow mask 4 to approach the screen 8 due to the thermal expansion of the shadow mask 4 may be used instead of the flat springs 6, as shown in FIG. 7. The supporting mechanism 16, as shown in FIG. 7, herein comprises flat members 17, 18, 19 connecting the stud pins 5 with the Frame 7. Hence, the shadow mask 4 and frame 7 which are in positions shown by the dotted lines when the color picture tube is cold, move to positions shown by the solid lines when the color picture tube is hot due to the thermal expansion of the shadow mask 4 and the action of the flat members 17, 18, 19. According to the second embodiment, therefore, the shadow mask 4 and frame 7 move in a direction perpendicular to the screen 8 (the front-back direction of the tube), but as the metal members 14 are flexible, this does not interfere with the action of the shadow mask 4. The remaining parts of the construction of the second embodiment are identical to those of the first embodiment.

THIRD EMBODIMENT

Figure 8:
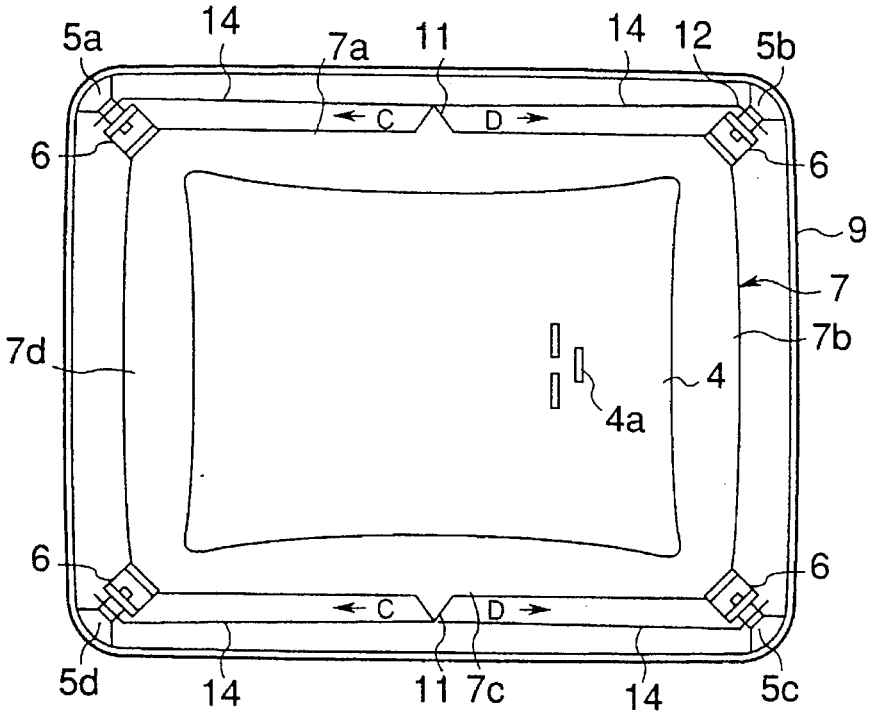
FIG. 8 is a view of the structure of a third embodiment of the shadow mask color picture tube according to this invention viewed from the electron gun.

FIG. 8 is a view of the structure of a third embodiment of the color picture tube according to this invention viewed From the electron gun. According to the first embodiment, the ease was described where each of the long sides 7*a*, 7*c* of the frame 7 is provided with two projections, but each of the long sides 7*a*, 7*c* may be provided with only one projection 11 as shown in FIG. 8. The remaining parts of the construction of the third embodiment are identical to those of the aforesaid first or second embodiments.

FOURTH EMBODIMENT

Figure 9:
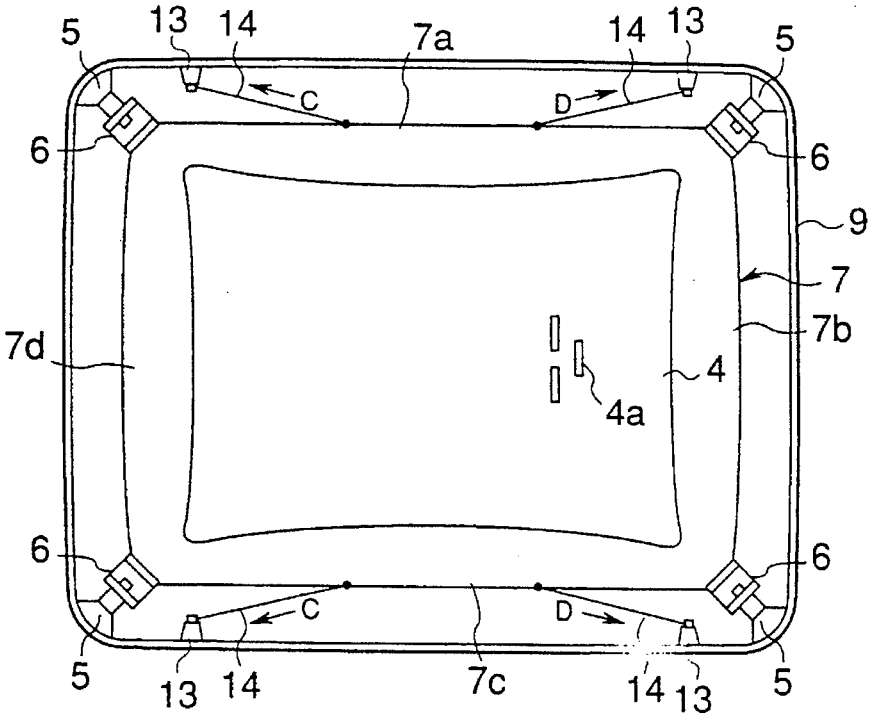
FIG. 9 is a view of the structure of a fourth embodiment of the shadow mask color picture tube according to this invention viewed from the electron gun.

FIG. 9 is a view of the structure of a fourth embodiment of the color picture tube according to this invention viewed from the electron gun. According to the first embodiment, the case was described where each of the long sides 7*a*, 7*c* of the frame 7 is provided with two projections 11, and the metal members 14 are attached to the stud pins 5 provided with the flat springs 6. However, other pins 13 may be provided on the skirt 9 as shown in FIG. 9, and these pins 13 attached to the long sides 7*a*, 7*c* without projections by the metal members 14. The remaining parts of the construction of the fourth embodiment are identical to those of the aforesaid first or second embodiments.

FIFTH EMBODIMENT

Figure 10:
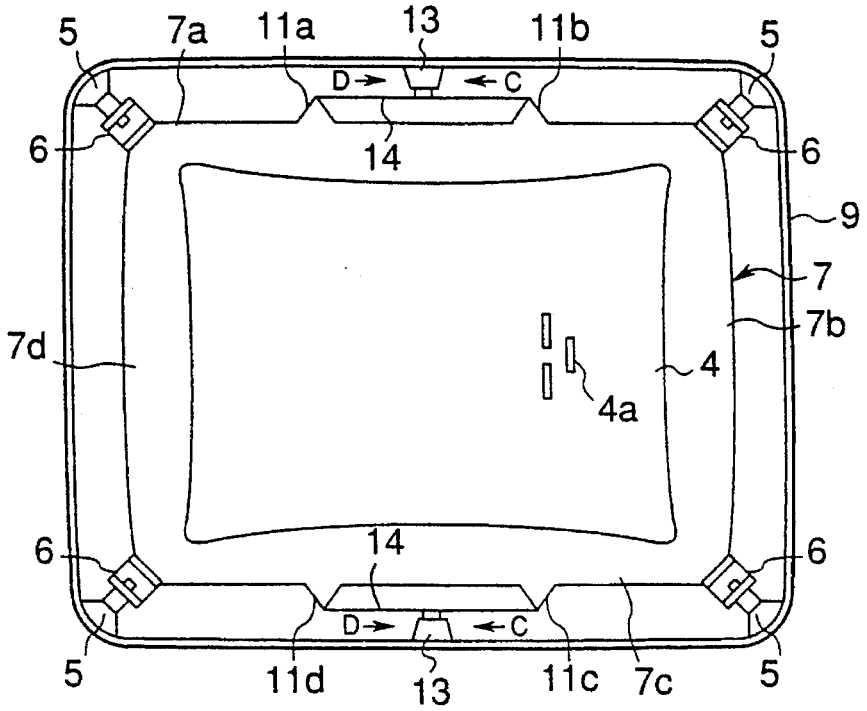
FIG. 10 is a view of the structure of a fifth embodiment of the shadow mask color picture tube according to this invention viewed from the electron gun.

FIG. 10 is a view of the structure of a fifth embodiment of the color picture tube according to this invention viewed from the electron gun. According to the first embodiment, the case was described where the stud pins provided with the flat springs are connected to the projections by means of the metal members 14, but other pins 13 may be provided on the upper and lower inner walls of the skirt 9 as shown in FIG. 10, and these pins 13 attached to the projections 11*a*, 11*b*, 11*c*, 11*d* by the metal members 14 which exert a tensile force in the direction C or D. The remaining parts of the construction of the fifth embodiment are identical to those of the aforesaid first or second embodiments.

SIXTH EMBODIMENT

Figure 11:
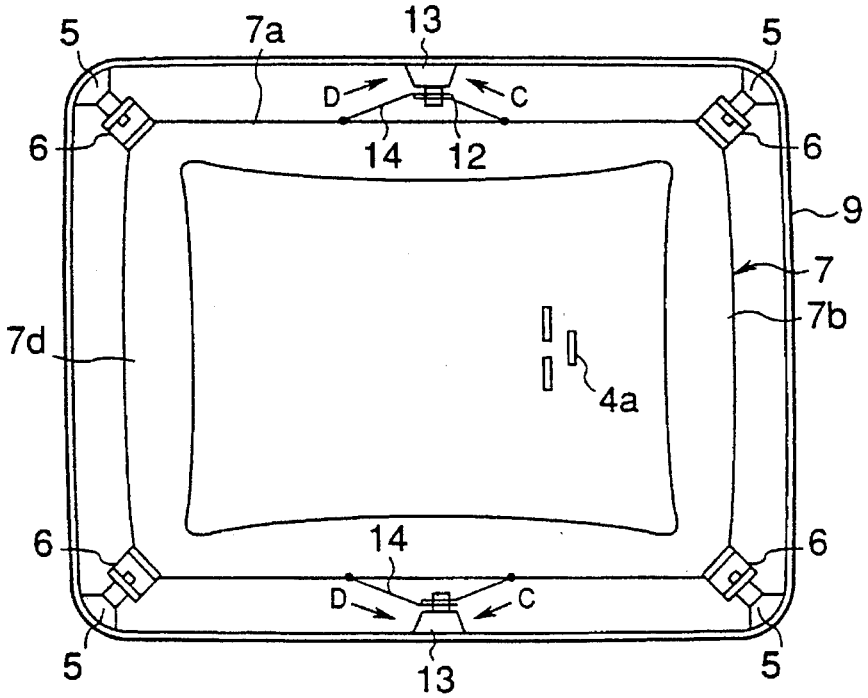
FIG. 11 is a view of the structure of a sixth embodiment of the shadow mask color picture tube according to this invention viewed from the electron gun.

FIG. 11 is a view of the structure of a sixth embodiment of the color picture tube according to this invention viewed from the electron gun. According to the first embodiment, the case was described where each of the long sides 7*a*, 7*c* of the frame 7 is provided with two projections, and the metal members 14 are attached to the stud pins 5 provided with the flat springs 6. However, other pins 13 may be provided on the upper and lower inner walls of the skirt 9 as shown in FIG. 11, and these pins 13 attached to the long sides 7*a*, 7*c* by the metal members 14 which exert a tensile force in the direction C or D. The remaining parts of the construction of the sixth embodiment are identical to those of the aforesaid first or second embodiments.

SEVENTH EMBODIMENT

Figure 12:
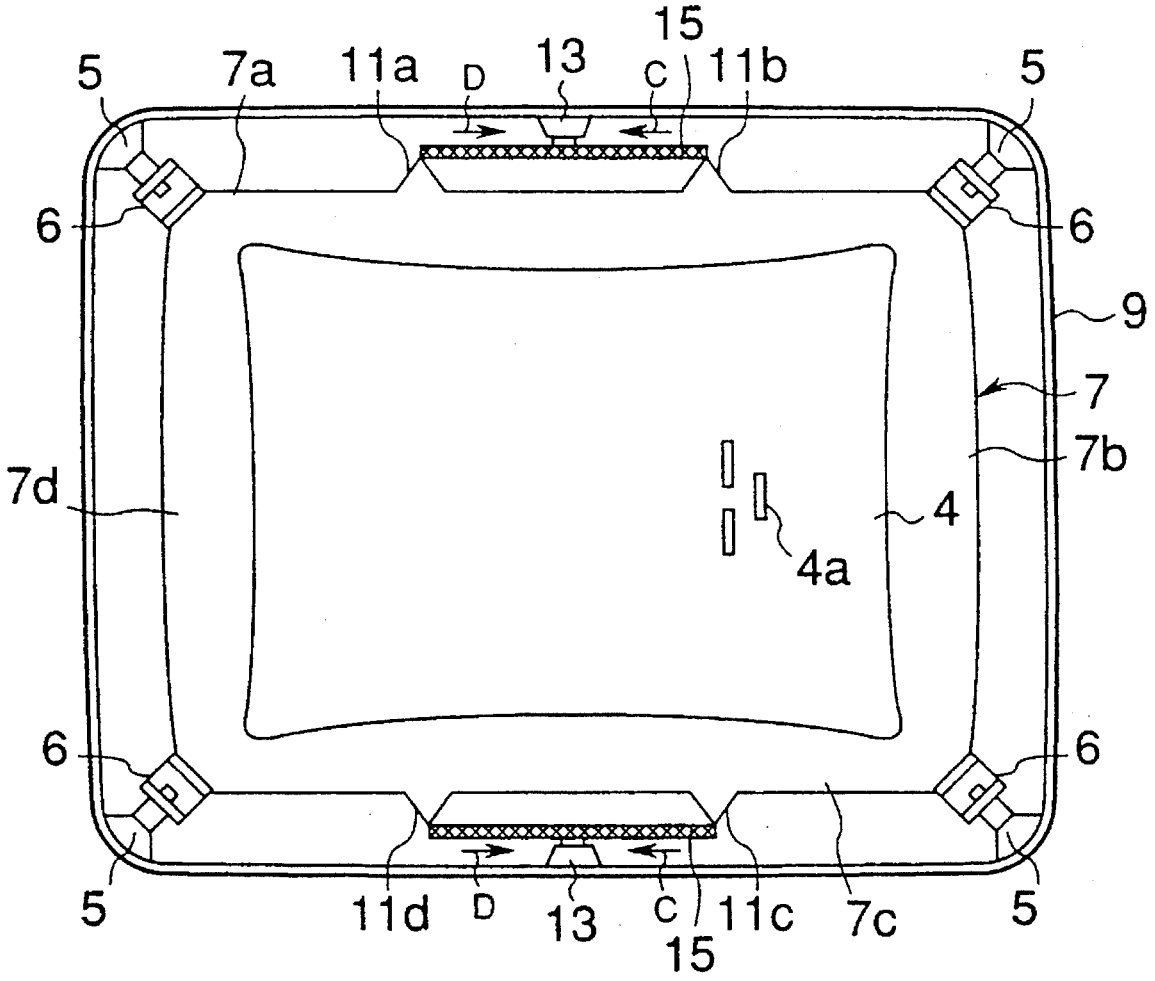
FIG. 12 is a view of the structure of a seventh embodiment of the shadow mask color picture tube according to this invention viewed from the electron gun.

FIG. 12 is a view of the structure of a seventh embodiment of the color picture tube according to this invention viewed from the electron gun. According to the first embodiment, the case was described where the stud pins provided with the flat springs 6 are connected with the projections by means of the metal members 14. However, other pins 13 may be provided on the upper and lower inner walls of the skirt 9 as shown in FIG. 12, and these pins connected with the projections 11*a*, 11*b*, 11*c*, 11*d* by means of strip-shaped members 15 which exert a tensile force in the direction C or D. In this case, the strip-shaped members 15 are arranged parallel to the screen 8 so that they do not interfere with the Front-back motion of the shadow mask 4. The remaining parts of the construction of the seventh embodiment are identical to those of the first or second embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shadow mask color picture tube comprising:

a neck provided with an electron gun;

a funnel joined to said neck;

a panel including a rectangular image display screen whereon a plurality of phosphors are positioned and a skirt extending from edges of said image display screen to said funnel;

a shadow mask having a plurality of throughholes through which electron beams from said electron gun pass and facing said image display screen;

a frame for holding said shadow mask having two first parts each extending in a same direction and two second parts each extending in a perpendicular direction with respect to said first parts;

stud pins provided at the corners of said skirt;

first supporting members provided on the corners of said frame and connected to said stud pins so as to support said frame elastically on said skirt; and non-extensible, flexible, elongated and thin second supporting members extending substantially along said first parts which pull both of said two first parts of said frame with equal forces with respect to said skirt of said panel when said color picture tube is positioned such that said first parts extend in a direction perpendicular to a direction of gravity, wherein the forces act in a direction substantially parallel to that in which said first parts extend.

2. The shadow mask color picture tube as defined in claim 1, wherein said second supporting members pull one of said first parts with respectively equal forces acting in substantially opposite directions substantially parallel to that in which said first parts extend, and pull the other one of said first parts with respectively equal forces acting in substantially opposite directions substantially parallel to that in which said first parts extend.

3. The shadow mask color picture tube as defined in claim 1, wherein said first supporting members allow said shadow mask to approach said image display screen due to thermal expansion of said shadow mask.

4. The shadow mask color picture tube as defined in claim 1, wherein the phosphors of said panel take the form of thin bars extending substantially perpendicular to said first parts of said frame.

5. The shadow mask color picture tube as defined in claim 1, wherein said first supporting members are flat springs that exert a force in a direction tending to separate the corners of said frame from the corners of said skirt.

6. The shadow mask color picture tube as defined in claim 1, wherein said second supporting members are metal wires having a smaller thermal expansion coefficient than that of said panel.

7. The shadow mask color picture tube as defined in claim 1, wherein said second supporting members are metal strips or wires having a smaller thermal expansion coefficient than that of said panel, said metal strips or wires being arranged such that their surfaces are parallel to said image display screen.

8. The shadow mask color picture tube as defined in claim 1, wherein said second supporting members are attached to said first parts of said frame and to said stud pins, said second supporting members exerting a force in a direction tending to pull said first parts of said frame towards each of said stud pins.

9. The shadow mask color picture tube as defined in claim 1, further comprising a projection provided on each of said first parts of said frame, wherein said second supporting members are attached to said projections and to said stud pins, said second supporting members exerting a force in a direction tending to pull said first parts of said frame towards each of said stud pins.

10. The shadow mask color picture tube as defined in claim 1, further comprising second stud pins provided on the inner walls of said skirt, wherein said second supporting members are attached to said first parts of said frame and to said second stud pins, said second supporting members exerting a force in a direction tending to pull said first parts of said frame towards said second stud pins.

11. The shadow mask color picture tube as defined in claim 1, further comprising second stud pins provided on the inner walls of said skirt, and a projection provided on each of said first parts of said frame, wherein said second supporting members are connected to said projections and to said second stud pins, said second supporting members exerting a force in a direction tending to pull said projections towards said second stud pins.

12. A method of mounting a shadow mask in a vacuum tube having a skirt comprising the steps of:

providing a frame for holding the shadow mask having two first parts extending in a same direction and two second parts extending in a perpendicular direction with respect to the first parts;

providing stud pins at the corners of the skirt;

connecting elastic first supporting members on the corners of the frame;

connecting the first supporting members to the stud pins to elastically support the frame on the skirt; and pulling both of the two first parts of the frame with equal forces with respect to the skirt when said color picture tube is positioned such that said first parts extend in a direction perpendicular to a direction of gravity with non-extensible, flexible, elongated and thin second supporting members extending substantially along said first parts, wherein the forces act in a direction substantially parallel to that in which the first parts of the frame extend.

13. The method of claim 12, further comprising the steps of:

pulling one of the first parts of the frame with respectively equal forces acting in substantially opposite directions substantially parallel to that in which the first parts extend with the second supporting members, and pulling the other one of the first parts of the frame with respectively equal forces acting in substantially opposite directions substantially parallel to that in which the first parts extend with the second supporting members.

14. The method of claim 12, wherein said pulling step further comprising the substeps of:

providing a projection on each of the first parts of the frame, attaching one end of the second supporting members to the respective projection, attaching the other end of the second supporting members to the respective stud pin, pulling the first parts of the frame towards each of the respective stud pins with the second supporting members.

15. The method of claim 12, further comprising the steps of:

providing second stud pins on the inner walls of the skirt, attaching one end of the second supporting members to the respective second stud pin, attaching the other end of the second supporting members to the first parts of the frame, pulling the first parts of the frame towards each of the respective second stud pins with the second supporting members.

16. The method of claim 15, further comprising the steps of:

providing a projection on each of the first parts of the frame, attaching one end of the second supporting members to the respective projection, attaching the other end of the second supporting members to the respective second stud pin, pulling the first parts of the frame towards each of the respective second stud pins with the second supporting members.

17. An apparatus for mounting a shadow mask in a vacuum tube having a skirt comprising:

a frame for holding the shadow mask having two first parts extending in a same direction and two second parts extending in a perpendicular direction with respect to the first parts;

stud pins provided at the corners of the skirt;

elastic first supporting members provided on the corners of said frame and connected to said stud pins to elastically support said frame on the skirt; and non-extensible, flexible, elongated and thin second supporting members extending substantially along said first parts and pulling both of the two first parts of said frame with equal forces with respect to the skirt when said color picture tube is positioned such that said first parts extend in a direction perpendicular to a direction of gravity, wherein the forces act in a direction substantially parallel to that in which the first parts of said frame extend.

18. The apparatus of claim 17, wherein said second support members pull one of the first parts of the frame with respectively equal forces acting in substantially opposite directions substantially parallel to that in which the first parts extend, and pull the other one of the first parts of the frame with respectively equal forces acting in substantially opposite directions substantially parallel to that in which the first parts extend.

19. The apparatus of claim 17, further comprising:

a projection provided on each of the first parts of said frame to which one end of said respective second supporting members is attached, wherein the other end of said second supporting members is attached to said respective stud pin, and wherein the first parts of said frame are pulled towards each of said respective stud pins by said second supporting members.

20. The apparatus of claim 17, further comprising:

second stud pins provided on the inner walls of the skirt, wherein one end of said second supporting members is attached to said respective second stud pin, wherein the other end of said second supporting members is attached to the first parts of said frame, and wherein the first parts of the frame are pulled towards each of the respective second stud pins by the second supporting members.

21. The apparatus of claim 17, further comprising:

a projection provided on each of the first parts of said frame, wherein one end of said second supporting members is attached to the respective projection, wherein the other end of said second supporting members is attached to said respective second stud pin, and wherein the first parts of said frame are pulled towards each of said respective second stud pins by the second supporting members.

* * * * *

UNITED STATES PATENT AND TRADEMARK OFFICE

CERTIFICATE OF CORRECTION

PATENT NO. : 5,576,595
DATED : November 19, 1996
INVENTOR(S) : Hiroyoshi Inoue

It is certified that error appears in the above-indentified patent and that said Letters Patent is hereby corrected as shown below:

On the title page, item [73],

Assignees: Mitsubishi Denki Kabushiki Kaisha
Tokyo, Japan

Mitsubishi Electric Engineering Company Limited
Tokyo, Japan

Signed and Sealed this

Nineteenth Day of August, 1997

*Attest:*

*Attesting Officer*

BRUCE LEHMAN

*Commissioner of Patents and Trademarks*